US008516820B2

(12) United States Patent
Ramier et al.

(10) Patent No.: US 8,516,820 B2
(45) Date of Patent: Aug. 27, 2013

(54) INTEGRAL FLOW SLEEVE AND FUEL INJECTOR ASSEMBLY

(75) Inventors: Stephen A. Ramier, New Brunswick (DE); William R. Ryan, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 1259 days.

(21) Appl. No.: 12/180,637

(22) Filed: Jul. 28, 2008

(65) Prior Publication Data

US 2010/0018209 A1 Jan. 28, 2010

(51) Int. Cl.
*F02C 7/22* (2006.01)

(52) U.S. Cl.
USPC ..... 60/737; 60/760

(58) Field of Classification Search
USPC ..... 60/737–739, 740, 755–758, 760, 60/743, 796, 752; 431/8–10, 174–176, 181–185, 187, 278, 431/280, 281, 284, 285, 350–353
See application file for complete search history.

(56) References Cited

U.S. PATENT DOCUMENTS

| | | | | |
|---|---|---|---|---|
| 2,920,449 | A | 1/1960 | Johnson et al. | |
| 4,485,630 | A * | 12/1984 | Kenworthy | 60/757 |
| 5,323,600 | A | 6/1994 | Munshi | |
| 5,454,221 | A | 10/1995 | Loprinzo | |
| 5,487,275 | A | 1/1996 | Borkowicz et al. | |
| 5,575,154 | A | 11/1996 | Loprinzo | |
| 5,660,045 | A * | 8/1997 | Ito et al. | 60/737 |
| 5,901,555 | A * | 5/1999 | Mandai et al. | 60/747 |
| 5,937,653 | A | 8/1999 | Alary et al. | |
| 6,065,282 | A | 5/2000 | Fukue et al. | |
| 6,487,860 | B2 | 12/2002 | Mayersky et al. | |
| 6,796,130 | B2 | 9/2004 | Little et al. | |
| 6,843,061 | B2 | 1/2005 | Parker et al. | |
| 6,996,991 | B2 | 2/2006 | Gadde et al. | |
| 7,028,483 | B2 | 4/2006 | Mansour et al. | |
| 7,080,515 | B2 | 7/2006 | Wasif et al. | |
| 7,082,770 | B2 | 8/2006 | Martling et al. | |
| 7,249,461 | B2 | 7/2007 | Moraes | |
| 2004/0055306 | A1 | 3/2004 | North et al. | |
| 2006/0101801 | A1 | 5/2006 | Bland | |
| 2007/0130958 | A1 | 6/2007 | Ohri et al. | |
| 2007/0137207 | A1 * | 6/2007 | Mancini et al. | 60/737 |
| 2007/0220898 | A1 | 9/2007 | Hessler | |

OTHER PUBLICATIONS

L.B. Davis and S.H. Black; Dry Low NOx Combusion Systems for GE Heavy-Duty Gas Turbines, GE Power Systems GER-3568G article, Oct. 2000, pp. 1-22, USA.

* cited by examiner

*Primary Examiner* — Andrew Nguyen

(57) ABSTRACT

A fuel injector assembly for use in a turbine engine having a combustion section and a turbine section downstream from the combustion section. The fuel injector assembly includes a flow sleeve defining a pre-mixing passage of the combustion section and including a sleeve wall having a forward end proximate to a cover plate of the combustion section and an opposed aft end. An annular cavity in fluid communication with a source of fuel is formed in the sleeve wall adjacent the aft end. A fuel dispensing structure is associated with the cavity and includes at least one fuel distribution aperture for distributing fuel from the cavity to the pre-mixing passage.

15 Claims, 5 Drawing Sheets

INTEGRAL FLOW SLEEVE AND FUEL INJECTOR ASSEMBLY

CROSS REFERENCE TO RELATED APPLICATION

This application is related to U.S. patent application Ser. No. 12/180,657, filed concurrently herewith, entitled "TURBINE ENGINE FLOW SLEEVE", the entire disclosure of which is incorporated by reference herein.

FIELD OF THE INVENTION

The present invention relates to a fuel injector assembly, and more particularly, to a fuel injector assembly that is integrally formed with a flow sleeve of a combustion section in a gas turbine engine.

BACKGROUND OF THE INVENTION

In gas turbine engines, compressed air discharged from a compressor section and fuel introduced from a source of fuel are mixed together and burned in a combustion section. The mixture is directed through a turbine section, where the mixture expands to provide rotation of a turbine rotor. The turbine rotor may be linked to an electric generator, wherein the rotation of the turbine rotor can be used to produce electricity in the generator.

The combustion section of a typical gas turbine engine may include a fuel injector assembly that distributes fuel into the compressed air stream before the stream reaches main and pilot fuel injectors of a combustion chamber in a process referred to as pre-mixing. The pre-mixing process provides a high degree of flexibility during engine tuning and is an important component for engine emissions and dynamics.

One type of prior art fuel injector assembly comprises a ring-type fuel injector assembly including a fuel ring, a fuel supply tube, and attachment legs for attaching the assembly to a portal or flow sleeve of the combustion section of the engine. Fuel is delivered from a source of fuel to the fuel supply tube, which conveys the fuel to the fuel ring. The fuel is delivered into the air stream through an annular array of apertures that are formed in a radially inward surface of the fuel ring. Such a prior art fuel injector assembly is disclosed in U.S. Pat. No. 7,249,461, the entire disclosure of which is hereby incorporated by reference.

Common problems associated with prior art fuel injector assemblies include inadequate structural integrity and the delivery of fuel too closely to a liner assembly of the combustion section. Inadequate structural integrity may lead to fuel leakage and decrease engine efficiency. Delivering the fuel too closely to the liner assembly can be problematic in that the fuel may auto-ignite near the liner surface and burn holes in the liner.

There is a continuing need to provide a fuel injector assembly that delivers an efficient amount of fuel into the air stream from the compressor section while having adequate structural integrity to prevent fuel leakage and which also reduces the risk of auto-igniting in the vicinity of the liner assembly.

SUMMARY OF THE INVENTION

In accordance with a first aspect of the present invention, a fuel injector assembly is provided for use in a turbine engine comprising a compressor section, a combustion section, and a turbine section downstream from the combustion section. The fuel injector assembly comprises a flow sleeve defining a pre-mixing passage of the combustion section and comprises a sleeve wall having a forward end proximate to a cover plate of the combustion section and an opposed aft end. A cavity formed in the sleeve wall is in fluid communication with a source of fuel. A fuel dispensing structure is associated with the cavity and includes at least one fuel distribution aperture formed therein for distributing fuel from the cavity to the pre-mixing passage.

In accordance with a second aspect of the present invention, a fuel injector assembly is provided for use in a turbine engine comprising a compressor section, a combustion section, and a turbine section downstream from the combustion section. The fuel injector assembly comprises a flow sleeve defining a pre-mixing passage of the combustion section and comprises an annular sleeve wall having a forward end proximate to a cover plate of the combustion section and an opposed aft end. The flow sleeve is associated with a fuel feed passageway in fluid communication with a source of fuel and includes an annular channel and an associated fuel dispensing structure. The annular channel defines a fuel flow passageway formed in a radially inner surface of the sleeve wall adjacent to the sleeve wall aft end and in fluid communication with the fuel feed passageway. The fuel dispensing structure includes a plurality of fuel distribution apertures formed therein for delivering fuel from the annular channel to the pre-mixing passage circumferentially about the flow sleeve.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
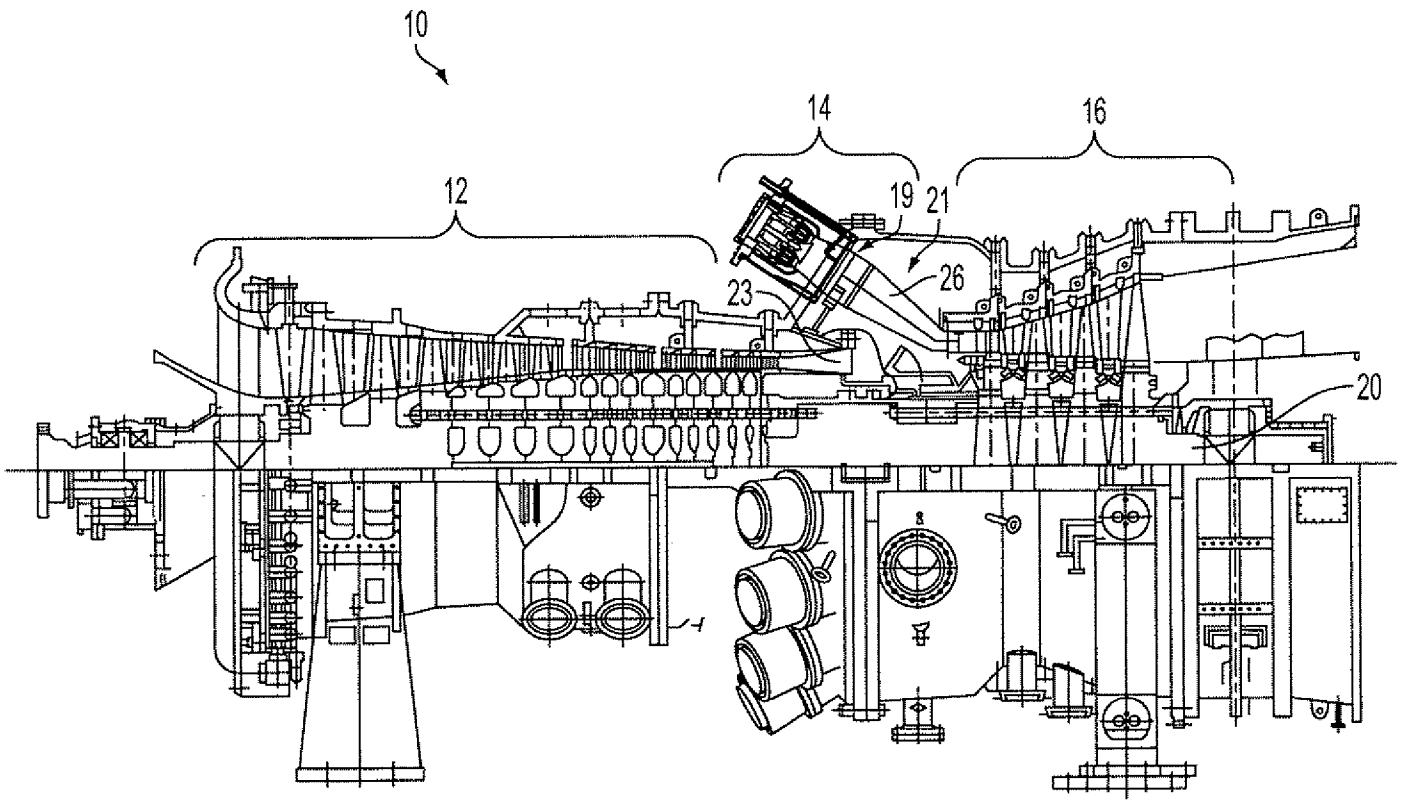
FIG. 1 is a sectional view of a gas turbine engine including a plurality of combustors incorporating pre-mix fuel injector assemblies according to an embodiment of the invention.

Referring to FIG. 1, a gas turbine engine 10 is shown. The engine 10 includes a compressor section 12, a combustion section 14 including a plurality of combustors 13, and a turbine section 16. The compressor section 12 inducts and pressurizes inlet air which is directed to the combustors 13 in the combustion section 14. Upon entering the combustors 13, the compressed air from the compressor section 12 is pre-mixed with a fuel in a pre-mixing passage 18 (see FIG. 2). The pre-mixed fuel and air then flows into a combustion chamber 14A where it is mixed with fuel from one or more main fuel injectors 15 and a pilot fuel injector 17 (see FIG. 2) and ignited to produce a high temperature combustion gas flowing in a turbulent manner and at a high velocity. The combustion gas then flows through a transition 26 to the turbine section 16 where the combustion gas is expanded to provide rotation of a turbine rotor 20 as shown in FIG. 1.

Figure 2:
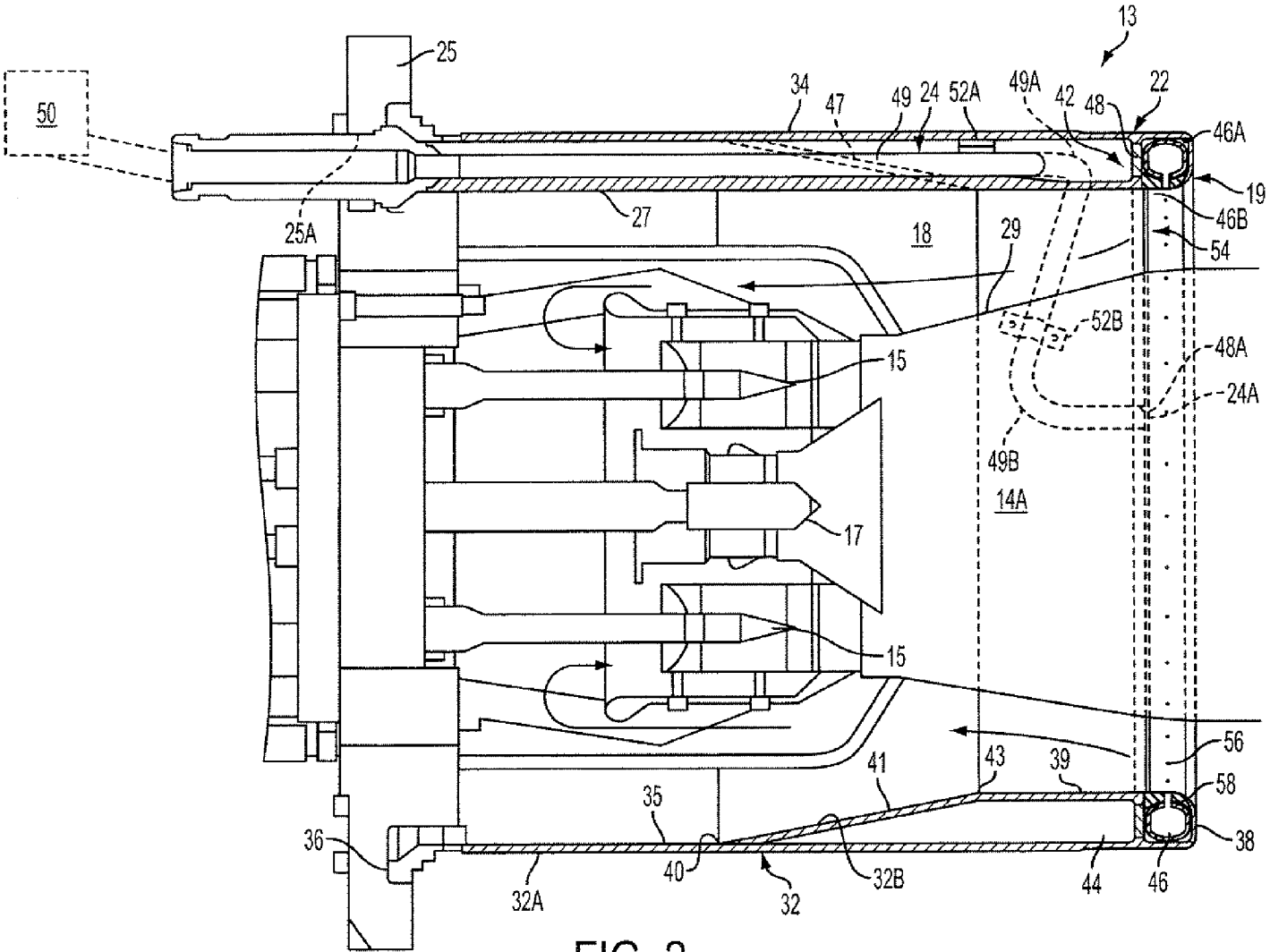
FIG. 2 is a side cross sectional view of one of the combustors incorporating the pre-mix fuel injector assemblies shown FIG. 1.

Referring to FIG. 2, the pre-mixing passage 18 is defined by a pre-mix fuel injector assembly 19 comprising a flow sleeve 22 surrounding a liner 29 of the combustion chamber 14A. The flow sleeve 22 may have a generally cylindrical configuration and may comprise an annular sleeve wall 32 that defines the pre-mixing passage 18 between the sleeve wall 32 and the liner 29. The flow sleeve 22 may be manufactured in any manner, such as, for example, by a casting procedure. Further, the sleeve wall 32 may comprise a single piece or section of material or a plurality of joined individual pieces or sections, and may be formed from any material capable of operation in the high temperature and high pressure environment of the combustion section 14 of the engine 10, such as, for example, stainless steel or carbon steel, and in a preferred embodiment comprises a steel alloy including chromium.

As shown in FIG. 2, the sleeve wall 32 includes a radially outer surface 34, a radially inner surface 35, a forward end 36, and an aft end 38 opposed from the forward end 36. The forward end 36 is affixed to a cover plate 25, i.e., with bolts (not shown). The aft end 38 defines an air inlet from a combustor plenum 21 (see FIG. 1), which receives the compressed air from the compressor section 12 via a compressor section exit diffuser 23 (see FIG. 1). The radially outer surface 34 is defined by a substantially cylindrical first wall section 32A that extends axially between the forward end 36 and the aft end 38. In the embodiment shown, the radially inner surface 35 is partially defined by the first wall section 32A and is partially defined by a second wall section 32B. The second wall section 328 comprises a conical shaped portion 41 and cylindrical shaped portion 39. The second wall section 32B is affixed to and extends from the first wall section 32A at an interface 40, as may be further seen in FIG. 2A. The second wall section 32B may be affixed to the first wall section 32A by any conventional means, such as by welding.

Figure 2A:
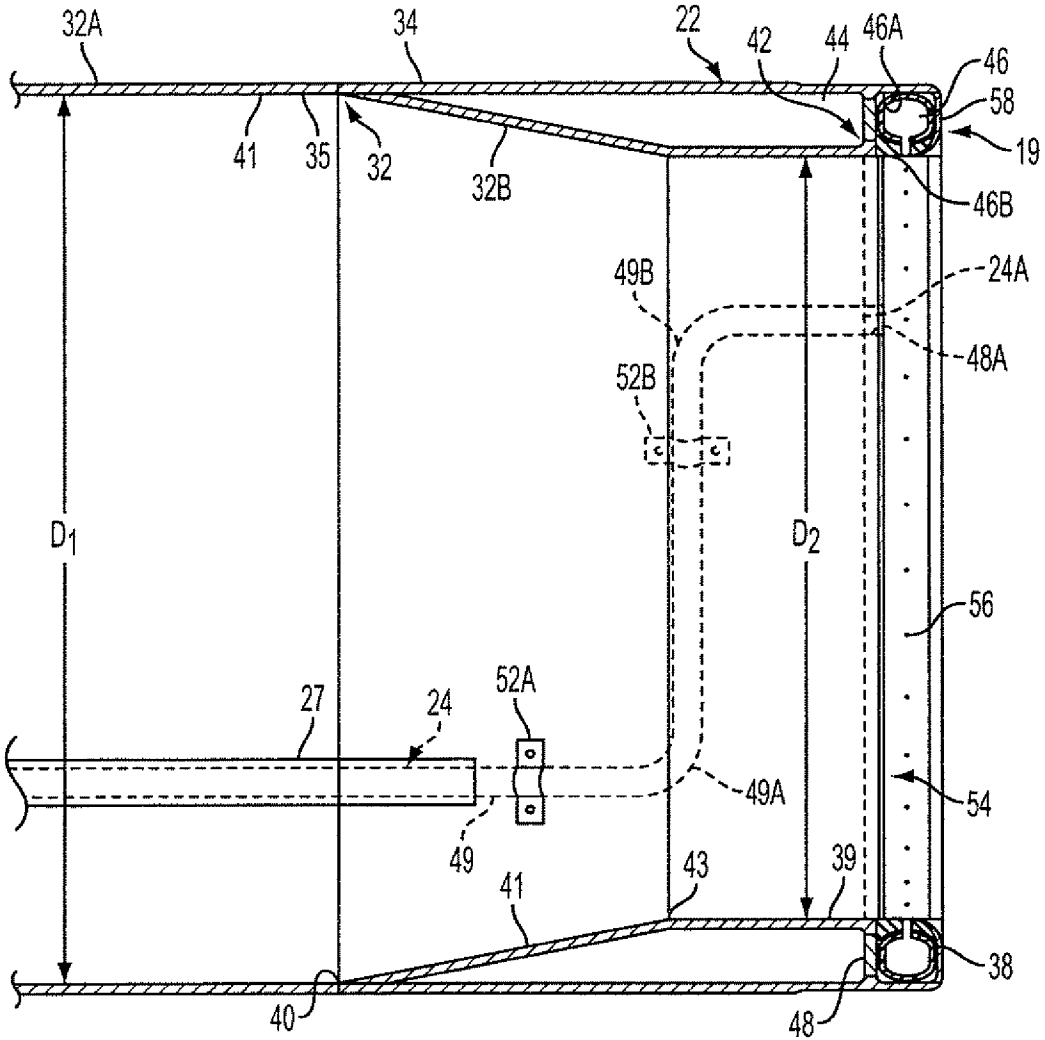
FIG. 2A is a side cross sectional view of the pre-mix fuel injector assembly illustrated in FIG. 2 shown removed from the combustor.

As seen in FIGS. 2 and 2A, the conical portion 41 of the second wall section 32B defines a transition between two inner diameters of the sleeve wall 32 extending axially between the forward end 36 and the aft end 38. Specifically, the conical portion 41 transitions between a first, larger inner diameter $D_1$, located adjacent to the forward end 36, and a second, smaller inner diameter $D_2$, located adjacent to the aft end 38 (see FIG. 2A). It is understood that the sleeve wall 32 may have a substantially constant diameter if desired, or the diameter $D_2$ of the aft end 38 could be greater than the diameter $D_1$ of the forward end 36.

Referring to FIGS. 2 and 2A, a cavity 42 is defined in the sleeve wall 32 adjacent to the sleeve wall aft end 38 between the first and second wall sections 32A, 32B. In the preferred embodiment, the cavity 42 comprises a first portion defining a transition chamber 44 and a second portion defining an annular fuel supply chamber 46, but may comprise any number of portions, including a single portion.

In the illustrated embodiment, the fuel supply chamber 46 is separated from the transition chamber 44 by a web member 48 extending radially between the first and second wall sections 32A, 328 and dividing the cavity 42 into the transition chamber 44 and the fuel supply chamber 46. It should be noted that although the web member 48 is illustrated as comprising a separate piece of material attached to the first and second wall sections 32A, 32B, the web member 48 could also be provided as integral with either or both of the first and second wall sections 32A, 32B of the sleeve wall 32.

The annular fuel supply chamber 46 comprises an annular channel 46A formed in the sleeve wall 32 and defines a fuel flow passageway for supplying fuel around the circumference of the sleeve wall 32 for distribution to the pre-mixing passage 18, as is described further below. The annular channel 46A may be formed in the sleeve wall 32 by any suitable method, such as, for example, by bending or forming the end of the sleeve wall 32 or by machining the annular channel 46A into the sleeve wall 32. In the embodiment shown, the annular channel 46A preferably extends circumferentially around the entire sleeve wall 32, but may extend around only a selected portion of the sleeve wall 32.

Referring to FIG. 2, the fuel injector assembly 19 further comprises a fuel feed passageway 24 provided for receiving a fuel supply tube 49 that is in fluid communication with a source of fuel 50 and extends through an aperture 25A in the cover plate 25. As may be further seen in FIG. 2A, the fuel feed passageway 24 is defined by a U-shaped cover structure 27 that is affixed to the inner surface 35 of the sleeve wall 32, such as by welding, for example, and is further defined by a slot or opening 47 (FIG. 2) defined in the second wall section 32B at the conical portion 41. Hence, the fuel supply tube 49 provides fluid communication for conveying fuel between the source of fuel 50 and the fuel supply chamber 46 of the cavity 42 by passing through the aperture 25A in the cover plate 25, through the fuel feed passageway 24, including the opening 47, and through the transition chamber 44 of the cavity 42.

Figure 3:
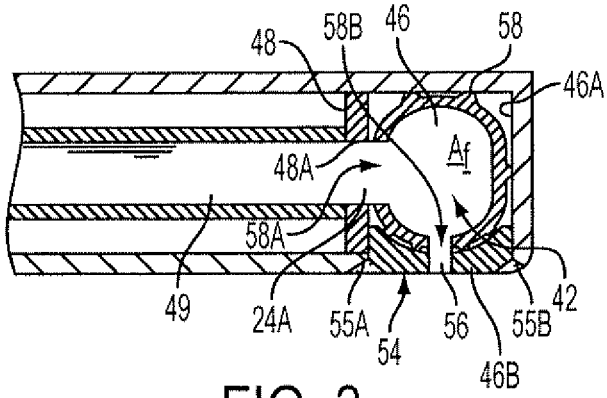
FIG. 3 is an enlarged cross sectional view of a portion of the pre-mix fuel injector assembly illustrated in FIG. 2.

Referring to FIG. 3, the fuel supply tube 49 is affixed to the web member 48, for example, by welding, such that a fluid outlet 24A of the fuel supply tube 49 is in fluid communication with the fuel supply chamber 46 of the cavity 42 via an aperture 48A formed in the web member 48. Preferably, as most clearly shown in FIG. 2A, the fuel supply tube 49 may include a series of bends 49A, 49B or circumferential direction shifts within the transition chamber 44 of the cavity 42, so as to provide the fuel supply tube 49 with an S-shape. The bends 49A, 49B may reduce stress to the fuel supply tube 49 caused by a thermal expansion and contraction of the fuel supply tube 49 and the flow sleeve 22 during operation of the engine 10, accommodating relative movement between the fuel supply tube 49 and the sleeve wall 32, such as may result from thermally induced movement of one or both of the fuel supply tube 49 and sleeve wall 32. The fuel supply tube 49 may be secured to the sleeve wall 32 at various locations with fasteners 52A, 52B, illustrated herein by straps, as seen in FIGS. 2 and 2A. It should be understood that other types of fasteners could be used and could be employed in different locations than those illustrated in FIGS. 2 and 2A.

Referring to FIGS. 2, 2A and 3, a fuel dispensing structure 54 is associated with the annular channel 46A and, in the preferred embodiment, comprises an annular segment 46B of the sleeve wall 32 adjacent the aft end 38. In the embodiment shown, the annular segment 46B is provided as a separate element affixed in sealing engagement over the annular channel 46A to form a radially inner boundary for the annular channel 46A, and is configured to distribute fuel into the pre-mixing passage 18. For example, the annular segment 46B may be welded to the sleeve wall 32 at first and second welds 55A, 55B (see FIG. 3) on opposed sides of the annular channel 46A at an interface between the annular segment 46B and the sleeve wall 32 to create a substantially fluid tight seal with the sleeve wall 32. It should be noted that other means may be provided for affixing the annular segment 46B to the sleeve wall 32 and that the annular segment 46B of the fuel dispensing structure 54 could be formed integrally with the sleeve wall 32.

The fuel dispensing structure 54 further includes a plurality of fuel distribution apertures 56 formed in the annular segment 46B. In a preferred embodiment, the fuel distribution apertures 56 comprise an annular array of openings or through holes extending through the annular segment 46B. The fuel distribution apertures 56 may be substantially equally spaced in the circumferential direction, or may be configured in other patterns as desired, such as, for example, a random pattern. The fuel distribution apertures 56 are adapted to deliver fuel from the fuel supply chamber 46 to the pre-mixing passage 18 at predetermined circumferential locations about the flow sleeve 22 during operation of the engine 10. The number, size and locations of the fuel distribution apertures 56, as well as the dimensions of the fuel supply chamber 46, are preferably configured to deliver a predetermined flow of fuel to the pre-mixing passage 18 for pre-mixing the fuel with incoming air as the air flows to the combustion chamber 14A.

Referring to FIG. 3, the fuel supply chamber 46 may be provided with a thermally resistant sleeve 58, i.e., a sleeve formed of a material having a high thermal resistance, therein. The thermally resistant sleeve 58 may be formed from a thin piece of metallic material, such as stainless steel, and defines an annular cross-sectional shape, as seen in FIG. 3, that generally extends out to the interior surfaces of the fuel supply chamber 46 and that defines a flow area $A_f$ for conveying fuel circumferentially through the fuel supply chamber 46. A fluid inlet 58A is formed in the sleeve 58 located in fluid communication with the fuel supply tube 49 adjacent to the aperture 48A in the web member 48. The sleeve 58 also includes openings 58B formed therein corresponding to the locations of the fuel distribution apertures 56 in the fuel dispensing structure 54 for permitting passage of fuel out of the sleeve 58 into the pre-mixing passage 18.

Figure 3A:
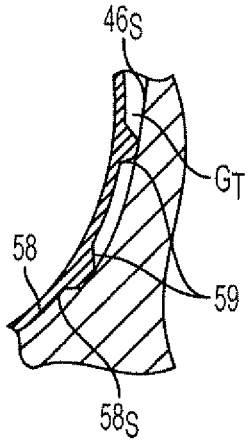
FIG. 3A is an enlarged cross sectional view illustrating a portion of a thermally resistant sleeve disposed in a cavity of the pre-mix fuel injector assembly illustrated in FIG. 3.

Referring further to FIG. 3A, the sleeve 58 is maintained in spaced relation to the surrounding annular channel 46A and the annular segment 46B. In particular, an outer surface 58*s* of the sleeve 58 may be provided with outwardly extending surface features 59, such as dimples or other features formed at discrete locations around the outer surface 58*s*, to define a gap $G_T$ between an inner surface 46*s* of the fuel supply chamber 46 and a substantial portion of the outer surface 58*s* of the sleeve 58. The sleeve 58 and associated gap $G_T$ provide a thermal barrier to reduce the thermal gradient at the relatively hot inner surface 46*s* with respect to the relatively cool fuel passing through the flow area $A_f$ inside the sleeve 58. That is, the sleeve 58 and gap $G_T$ provide a degree of the thermal isolation for the hot inner surface 46*s* to reduce the thermal stress that may be created in the sleeve wall 32 by the relatively cooler fuel passing through the fuel supply chamber 46.

Since the fuel supply chamber 46 and the fuel dispensing structure 54 are formed integrally with the flow sleeve 22, separate fuel injector tubes and/or injector rings used in prior art fuel injector assemblies are not required. Thus, costs associated with installation of such separate fuel injector tubes and/or injector rings may be avoided or reduced with the present fuel injector assembly 19. Further, the possibility of damage to such separate fuel injector tubes and/or injector rings, which may occur during manufacturing, maintenance, or operation of the engine 10, for example, are reduced by the present design. Additionally, since the fuel dispensing apertures 56 may be further radially displaced from the liner 29 than in prior art engines, the possibility of auto-igniting the liner 29, which, in prior art engines, may result from the fuel injector assembly being located in closer proximity to the liner, is reduced.

Figure 4:
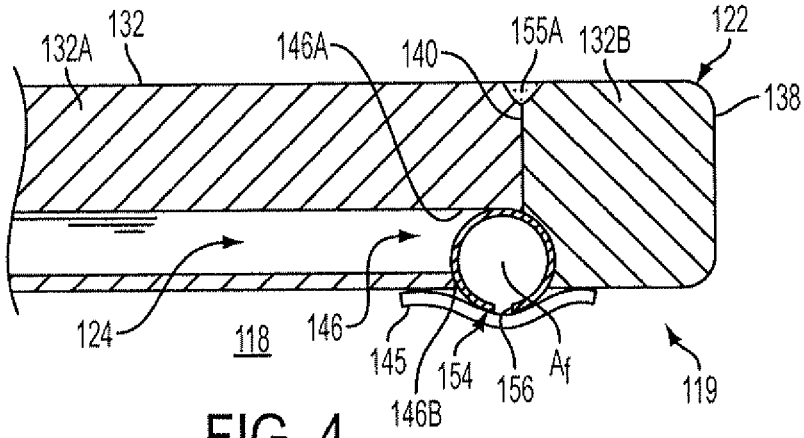
FIG. 4 is an enlarged cross sectional view of a portion of a pre-mix fuel injector assembly according to another embodiment of the invention.

FIG. 4 illustrates a pre-mix fuel injector assembly 119 according to a second embodiment of the invention, wherein elements corresponding to elements of the first described embodiment of the fuel injector assembly 19 (FIGS. 2, 2A and 3) are identified by the same reference numeral increased by 100. In the present embodiment, the fuel injector assembly 119 includes a flow sleeve 122 comprising a sleeve wall 132 defined by a first portion 132A and a second portion 132B. The first portion 132A extends from a forward end (not shown in this embodiment) of the sleeve wall 132 toward an aft end 138 of the sleeve wall 132 and terminates short of the aft end 138. The second portion 132B is mechanically affixed to the first portion 132A at a sleeve wall interface 140 such as by a welded connection 155A, to define the aft end 138 of the sleeve wall 132.

A cavity or annular fuel supply chamber 146 comprising an annular channel 146A is formed in the sleeve wall 32 proximate the interface 140 between the first and second portions 132A, 132B. In the illustrated embodiment, the annular channel 146A is formed partially in each of the first and second portions 132A and 132B, however, the annular channel 146A could be formed entirely in either of the first and second portions 132A, 132B. A fuel dispensing structure 154 is provided comprising a fuel dispensing tube 146B, such as a stainless steel tube, defining a flow area $A_f$ extending through the annular channel 146A. The fuel dispensing tube 146B includes a plurality of fuel distribution apertures 156 for providing a predetermined flow of fuel from the flow area $A_f$ to a pre-mixing chamber 118 surrounded by the flow sleeve 122. The fuel dispensing tube 146B is preferably at least partially captured within the annular channel 146A by the first and second portions 132A, 132B, and may be further, or alternatively, retained within the annular channel 146A by a plurality of straps 145 having opposing ends affixed, such as by welding, to the first and second portions 132A, 132B.

Fuel may be supplied to the fuel dispensing tube 146B by a fuel feed passageway 124 that is integrally formed in and extends axially through the first portion 132A of the sleeve wall 132 into fluid communication with the fuel dispensing tube 146B. The fuel feed passageway 124 is in fluid communication with a source of fuel (not shown in this embodiment), such as at a location adjacent to the forward end of the sleeve wall 132. Alternatively, a fuel supply tube (not shown) may be provided within, or instead of, the fuel feed passageway 124 for providing fuel to the tube 146B.

In the configuration in which the fuel dispensing tube 146B is retained by straps 145, the fuel dispensing tube 146B is preferably supported in such a way that the tube 146B may slide under the straps 145. In particular, the fuel dispensing tube 146B may be supported in sliding engagement within the annular channel 146A to reduce stress that may otherwise occur as a result of differential thermal expansion between the fuel dispensing tube 146B and the annular channel 146A. In this configuration, the fuel dispensing tube 146B may be formed with a split at a location that is diametrically opposite the location of the fuel feed passageway 124, with the open ends capped (not shown), to accommodate variations in the diametric dimension of the flow sleeve 122 during thermal expansion.

Figure 5:
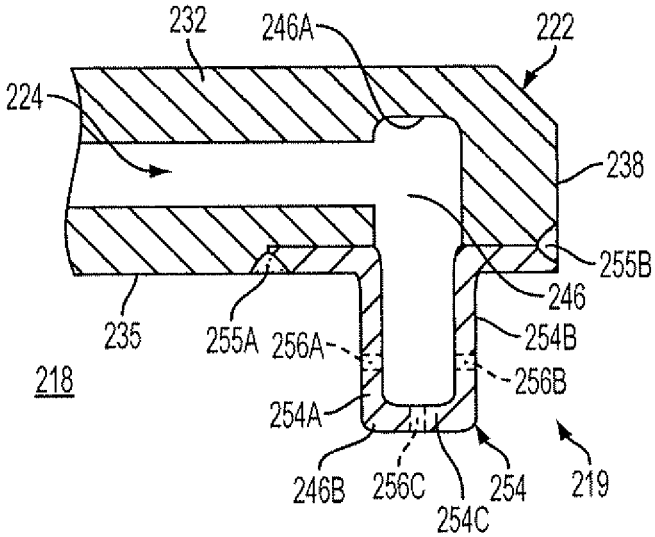
FIG. 5 is an enlarged cross sectional view of a portion of a fuel injector assembly according to a further embodiment of the invention.

FIG. 5 illustrates a pre-mix fuel injector assembly 219 according to a third embodiment of the invention, wherein elements corresponding to elements of the first described embodiment of the fuel injector assembly 19 (FIGS. 2, 2A and 3) are identified by the same reference numeral increased by 200. In the present embodiment, the fuel injector assembly 219 includes a flow sleeve 222 comprising an annular sleeve wall 232 extending from a forward end (not shown in this embodiment) to an aft end 238. A cavity or annular fuel supply chamber 246 comprising an annular channel 246A is formed in the sleeve wall 232 adjacent to the aft end 238.

A fuel dispensing structure 254 is associated with the annular channel 246A and, in the present embodiment, comprises an annular segment or cover structure 246B affixed to a radially inner surface 235 of the sleeve wall 232 to cover the annular channel 246A. The cover structure 246B is preferably affixed to the sleeve wall 232 at welds 255A, 255B to create the substantially fluid tight seal with the sleeve wall 232 at an interface between the cover structure 246B and the sleeve wall 232. In the embodiment shown, the welds 255A, 255B are located at opposed axially spaced locations from the annular channel 246A, such that the welds 255A, 255B are spaced from the area immediately adjacent to the annular channel 246A, where a substantial temperature gradient typically exists as a result of conveying the relatively cool fuel through the annular channel 246A. In particular, the inner surface 235 of the sleeve wall 232 is typically at or close to the temperature of the gas flowing through a pre-mixing passage 218, i.e., at approximately 450° C., and a temperature gradient may be created in the sleeve wall 232 in the area immediately adjacent to the annular channel 246A conveying the relatively cool fuel at a temperature of approximately 200° C. Accordingly, placing the welds 255A, 255B at locations spaced from this area of temperature gradient reduces the thermal stresses applied at the interface between the cover structure 246B and the sleeve wall 232 to maintain the integrity of the welds 255A, 255B.

The cover structure 246B of the fuel dispensing structure 254 extends radially inwardly into the pre-mixing passage 218 from a radially inner surface 235 of the sleeve wall 232 and includes an axially forward surface 254A facing the forward end of the sleeve wall 232, an axially aft surface 254B facing the aft end 238 of the sleeve wall 232, and a radially inner surface 254C between the forward and aft surfaces 254A, 254B. In one configuration of the present fuel injection assembly 219, the fuel dispensing structure 254 comprises a plurality of fuel distribution apertures 256A formed in an annular array in the axially forward surface 254A for conveying fuel from the fuel supply chamber 246 into the pre-mixing chamber 218. Alternatively, the fuel dispensing structure 254 may comprise a plurality of fuel distribution apertures 256B formed in the axially aft surface 254B, or the fuel dispensing structure 254 may comprise a plurality of fuel distribution apertures 256C formed in the radially inner surface 254C. Further alternative configurations could be formed by forming the fuel distribution structure 254 with a combination of a plurality of two or more of the fuel distribution apertures 254A, 254B, 254C. It should be noted that, while the portion of the cover structure 246B of fuel dispensing structure 254 is described and illustrated as having a generally rectangular cross-sectional shape extending into the pre-mixing chamber 218, the cover structure 246B may have any suitable shape, such as, for example, a triangular or a dome cross sectional shape. The radially inward extension of the fuel dispensing structure 254 into the pre-mixing passage 218 is believed to allow for a more turbulent delivery of the fuel into the pre-mixing passage 218, which may optimize mixing of the fuel with the air passing through the pre-mixing passage 218.

Fuel may be supplied to the fuel supply chamber 246 by a fuel feed passageway 224 that is integrally formed in and extends axially through the sleeve wall 232 into fluid communication with the fuel supply chamber 246. The fuel feed passageway 224 is in fluid communication with a source of fuel (not shown in this embodiment), such as at a location adjacent to the forward end of the sleeve wall 232. Alternatively, a fuel supply tube (not shown) may be provided within, or instead of, the fuel feed passageway 224 for providing fuel to the fuel supply chamber 246.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fuel injector assembly for use in a turbine engine comprising a compressor section, a combustion section, and a turbine section downstream from the combustion section, the fuel injector assembly comprising:

a flow sleeve defining a pre-mixing passage of the combustion section where fuel is mixed with air before entering a combustion chamber where the mixed fuel and air is mixed with additional fuel from at least one main fuel injector and a pilot fuel injector, the combustion chamber being defined by a liner, said flow sleeve disposed radially outward of the liner, and said pre-mixing passage being defined by said flow sleeve and the liner, said flow sleeve comprising a sleeve wall having a radially inner wall, a radially outer wall, a forward end proximate to a cover plate of the combustion section and an opposed aft end, said flow sleeve including:

a cavity portion formed in said aft end of said sleeve wall between said radially inner wall and said radially outer wall and in fluid communication with a source of fuel;

a fuel dispensing structure associated with said cavity portion including at least one fuel distribution aperture formed therein for distributing fuel from said cavity portion to said pre-mixing passage;

a fuel feed passageway disposed between said radially inner wall and said radially outer wall and comprising an axial passage formed in said sleeve wall;

a fuel tube extending through said fuel feed passageway for delivering fuel from said source of fuel to said cavity portion; and a web member coupling said radially inner wall and said radially outer wall and disposed between said fuel tube and said cavity portion, said web member including at least one aperture for delivering fuel from said fuel tube to said cavity portion.

2. The fuel injector assembly according to claim 1, wherein said cavity portion is formed in said sleeve wall adjacent to said sleeve wall aft end.

3. The fuel injector assembly according to claim 1, wherein said sleeve wall comprises an annular sleeve wall and said cavity portion comprises an annular channel defining a fuel flow passageway between said radially inner wall and said radially outer wall of said sleeve wall for conveying fuel circumferentially about said flow sleeve.

4. The fuel injector assembly according to claim 3, wherein said fuel dispensing structure includes an annular array of fuel distribution apertures formed therein for distributing fuel from said annular channel to said pre-mixing passage.

5. The fuel injector assembly according to claim 4, wherein said fuel dispensing structure comprises a cover structure adapted to cover at least a part of said cavity portion, said cover structure forming a substantially fluid tight seal with a radially inner surface of said sleeve wall at a sealed interface between said cover structure and said sleeve wall.

6. The fuel injector assembly according to claim 5, wherein said sealed interface between said cover structure and said sleeve wall is axially spaced from said cavity portion.

7. The fuel injector assembly according to claim 6, wherein said sealed interface comprises at least two mechanically affixed portions located on opposed axial sides of said cavity portion.

8. The fuel injector assembly according to claim 1, wherein said sleeve wall comprises an annular sleeve wall and said cavity portion comprises an annular channel and a thermally resistant sleeve in said annular channel, said thermally resistant sleeve defining a fuel flow passageway therein and including a fluid inlet in fluid communication with said source of fuel and at least one fluid outlet in fluid communication with said at least one fuel distribution aperture formed in said fuel dispensing structure.

9. The fuel injector assembly according to claim 8, wherein said thermally resistant sleeve includes a plurality of outwardly extending surfaces for spacing at least a portion of said thermally resistant sleeve from a surface of said annular channel.

10. The fuel injector assembly according to claim 1, wherein said flow sleeve comprises a first portion defining a first axial extent of said flow sleeve and a second portion defining a second axial extent of said flow sleeve, said second portion being mechanically affixed to said first portion, said sleeve wall comprises an annular sleeve wall, said cavity portion comprises an annular channel formed at an interface between said first portion and said second portion, and said fuel dispensing structure comprises a fuel dispensing tube captured in said annular channel.

11. A fuel injector assembly for use in a turbine engine comprising a compressor section, a combustion section, and a turbine section downstream from the combustion section, the fuel injector assembly comprising:

a flow sleeve defining a pre-mixing passage of the combustion section where fuel is mixed with air before entering a combustion chamber defined by a liner, said pre-mixing passage defined radially outwardly from the combustion chamber between said flow sleeve and the liner, said flow sleeve comprising an annular sleeve wall having a radially inner wall, a radially outer wall, a forward end proximate to a cover plate of the combustion section and an opposed aft end, said flow sleeve defining a fuel feed passageway between said radially inner wall and said radially outer wall, said flow sleeve including:

an annular channel formed between said radially inner wall and said radially outer wall in said sleeve wall aft end and including a thermally resistant sleeve defining a fuel flow passageway and including a fluid inlet in fluid communication with a source of fuel and at least one fluid outlet;

a fuel dispensing structure associated with said flow sleeve, said fuel dispensing structure including a plurality of fuel distribution apertures formed therein in fluid communication with said at least one fluid outlet of said thermally resistant sleeve for delivering fuel radially inwardly from said fuel flow passageway to said pre-mixing passage circumferentially about said flow sleeve;

an axially extending fuel tube disposed in said fuel feed passageway and delivering fuel to said fuel flow passageway; and a web member coupling said radially inner wall and said radially outer wall and disposed between said fuel tube and said annular channel, said web member including at least one aperture for delivering fuel from said fuel tube to said fuel flow passageway.

12. The fuel injector assembly according to claim 11, wherein said thermally resistant sleeve comprises a plurality of outwardly extending surfaces for spacing at least a portion of said thermally resistant sleeve from a surface of said annular channel.

13. The fuel injector assembly according to claim 11, wherein said fuel dispensing structure comprises a cover structure adapted to cover at least a portion of said annular channel, said cover structure mechanically affixed to said flow sleeve.

14. The fuel injector assembly according to claim 11, wherein said fuel feed passageway comprises an axial passage formed in said sleeve wall of said flow sleeve.

15. The fuel injector assembly according to claim 1, wherein said pre-mixing passage is located radially outwardly from the combustion chamber between the liner and said flow sleeve.

* * * * *